United States Patent [19]

Schmitt et al.

[11] Patent Number: 4,554,875

[45] Date of Patent: Nov. 26, 1985

[54] PEDESTAL TIE BAR ARRANGEMENT

[75] Inventors: Dallas L. Schmitt, Fairview Heights; Kenneth E. Spencer, Granite City, both of Ill.

[73] Assignee: Lukens General Industries, Inc., Coatesville, Pa.

[21] Appl. No.: 633,220

[22] Filed: Jul. 23, 1984

[51] Int. Cl.[4] ..... B61F 5/26

[52] U.S. Cl. ..... 105/221 R; 105/218 R; 403/11; 403/109

[58] Field of Search ..... 105/218 R, 218 A, 219, 105/220, 221 R, 221 K, 225; 213/61; 403/360, 109, 11

[56] References Cited

U.S. PATENT DOCUMENTS

| | | | |
|---|---|---|---|
| 700,894 | 5/1902 | Brown | 105/225 |
| 838,319 | 12/1906 | Green | 105/221 R |
| 864,329 | 8/1907 | North | 403/109 |
| 1,708,993 | 4/1929 | Woodman | 105/225 |
| 2,415,478 | 2/1947 | Forney | 403/109 |

*Primary Examiner*—Robert B. Reeves
*Assistant Examiner*—Dennis C. Rodgers
*Attorney, Agent, or Firm*—F. Travers Burgess

[57] ABSTRACT

A railway truck pedestal has a pedestal tie bar irremovably secured to one of the pedestal legs but arranged for easy movement between open and closed positions. The tie bar is of generally I-shape in plan and it is slidably mounted in channel-shaped saddles secured by their flanges to the bottom of the pedestal feet to provide generally aligned openings extending lengthwise of the pedestal. The saddle on one of the pedestal legs is slightly wider than the shoulders formed by the serifs on the tie bar and the channel of the saddle on the opposite pedestal foot is narrower than the shoulders formed by the serifs on the tie bar so that when it is desired to open the pedestal jaw, a bolt passing through one end of the tie bar and the corresponding saddle and pedestal foot can be removed and the tie bar slid through both saddles, the shoulders at the large saddle end passing through that saddle but engaging the saddle on the opposite pedestal foot so as to prevent removal of the tie bar after it has been moved to open position, the narrow saddle being offset longitudinally from the vertical transverse surface of the pedestal leg to which it is attached a distance at least equal to the thickness of the tie bar shoulder so as to permit the corresponding end of the tie bar to clear the inner transverse surface of that pedestal leg fully.

7 Claims, 6 Drawing Figures

PEDESTAL TIE BAR ARRANGEMENT

BACKGROUND OF THE INVENTION

1. Field of the Invention

The invention relates to railway rolling stock and consists particularly in an improved pedestal construction in which a pedestal tie bar is selectively movable between closed and open positions but is not removable from the pedestal.

2. The Prior Art

Commonly pedestal tie bars are removably secured to the lower ends or feet of pedestal legs by bolts or equivalent securing devices and are arranged for removal from the pedestal legs when it is desired to open the pedestal jaw, as for example when an axle is removed from a truck. Because of the relatively small size of pedestal tie bars, they are frequently lost when so removed and the replacement of large numbers of lost pedestal tie bars is both inconvenient and expensive. Conventional pedestal tie bars can also be lost when they fall off in transit due to loosening of the attaching bolts and this presents the additional danger that the pedestal jaw will be left open during operation of the car. A partial solution to this problem is shown in Perry Brown U.S. Pat. No. 700,894, in which a continuous tie rod 5, which functions both as pedestal tie bar on the individual pedestals and as a tie between separate pedestals is slidably received in loops or pockets 6 formed on the pedestal legs. While the loops of Brown would prevent the tie bar from falling from the truck so long as one of the fastening bolts and nuts was in place, it would not prevent the complete removal of the tie bar from the truck because, when the bolts were removed, the tie bar could be slid longitudinally out of all the loops and thus removed.

SUMMARY OF THE INVENTION

The invention provides a railway truck pedestal arrangement in which the pedestal tie bar can be between a position extending across and closing the pedestal jaw to an open position, but cannot be removed from the truck.

The invention further provides a pedestal tie arrangement requiring only one bolt and nut for locking the pedestal tie bar in closed position.

The invention further provides a pedestal construction in which the tie bar is slidably supported on the bottom of the pedestal feet and is movable between closed and open positions when the bolt and nut are released by sliding the tie bar to open position, the tie bar being provided with means for preventing its removal from one of the pedestal legs.

DETAILED DESCRIPTION OF THE INVENTION

Figure 1:
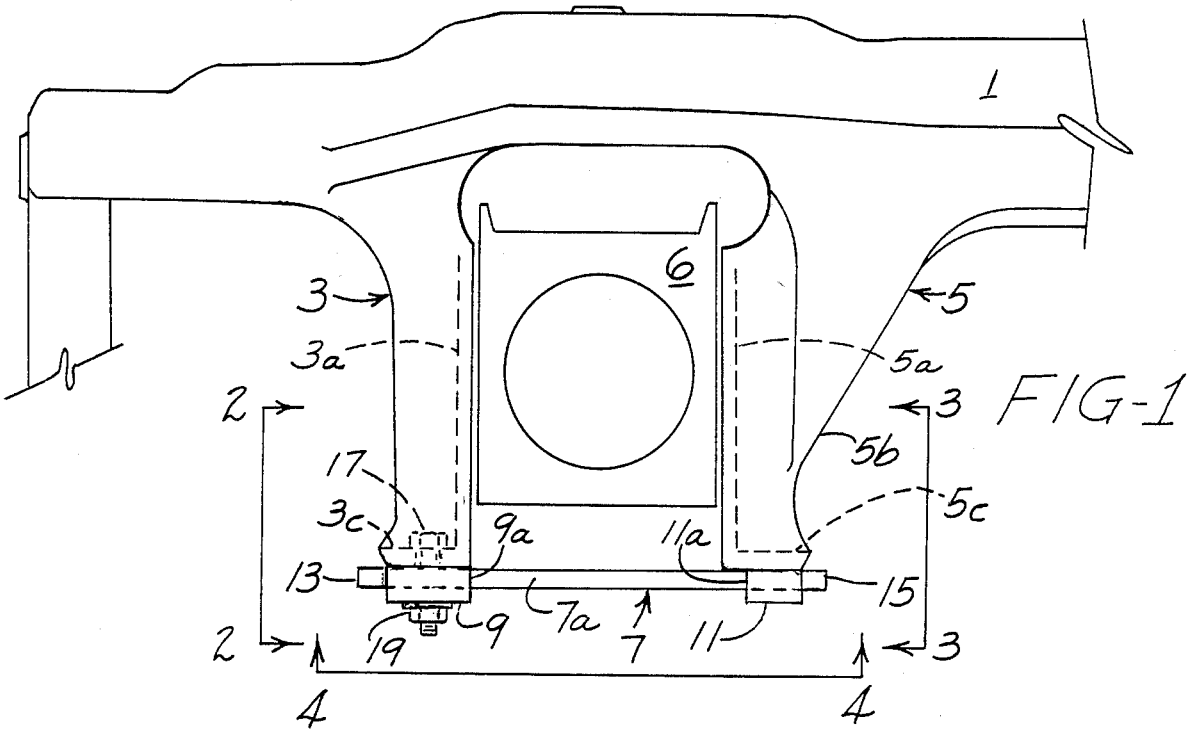
FIG. 1 is a fragmentary side elevational view of one end of a railway car truck frame showing a pedestal.
Figure 2:
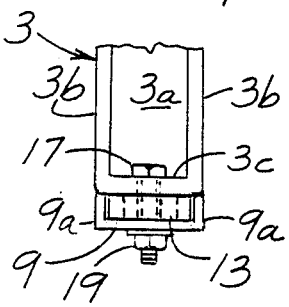
FIG. 2 is an end view of one of the pedestal legs taken from line 2—2 of FIG. 1.
Figure 3:
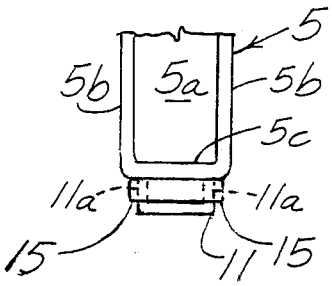
FIG. 3 is an end view of the other pedestal leg taken from line 3—3 of FIG. 1.
Figure 4:
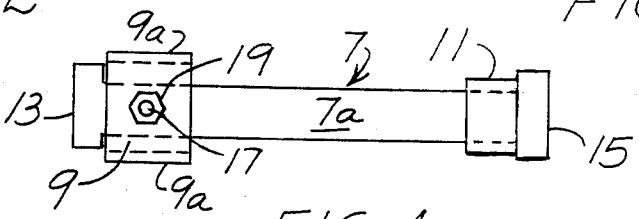
FIG. 4 is a bottom view of the pedestal taken from line 4—4 of FIG. 1, showing the pedestal tie bar in closed position.

Referring to FIG. 1, the numeral 1 indicates the wheel piece of a railway truck frame having depending pedestal legs 3 and 5 between which are slidably received a journal box 6. Pedestal legs 3 and 5 are of generally channel cross section having transverse webs 3*a* and 5*a* and spaced inner and outer flanges 3*b* and 5*b*, the lower ends of the pedestal legs terminating in transverse horizontal feet 3*c* and 5*c*.

For mounting the pedestal tie bar 7 to the feet 3*c* and 5*c* of pedestal legs 3 and 5, channel shaped saddles 9 and 11 are secured, preferably by welding their upright flanges 9*a* and 11*a* to the bottom surfaces respectively of pedestal feet 3*c* and 5*c*, the depth of saddles 9 and 11 being sufficient to slidably receive tie bar 7.

Tie bar 7 has a shank 7*a* and widened ends 13 and 15 forming shoulders projecting from the sides of the tie bar shank 7*a*, and the opening in saddle 9 is sufficiently wide to permit the passage therethrough of tie bar end 13, while saddle 11 is narrower than the width of tie bar ends 13 and 15 and is sufficiently wide to accommodate the shank of tie bar 7, saddle 11 being offset longitudinally from the inner surface of pedestal leg web 5*a* a sufficient distance to receive the widened end portion 13 of the tie bar so that the end surface of end portion 13 is flush with the transverse surface of pedestal leg web 5*a* when the tie bar is slid to its fully open position.

Figure 5:
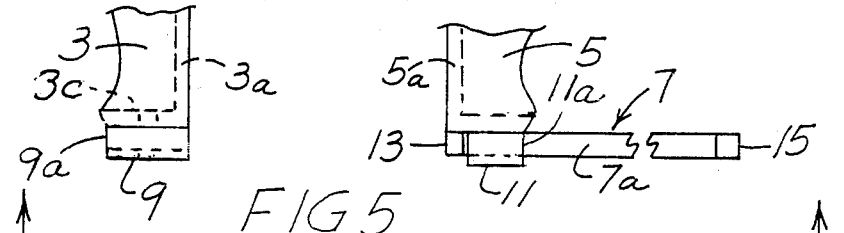
FIG. 5 is a fragmentary view of the lower portion of the pedestal shown in FIG. 1, showing the tie bar in open position.
Figure 6:
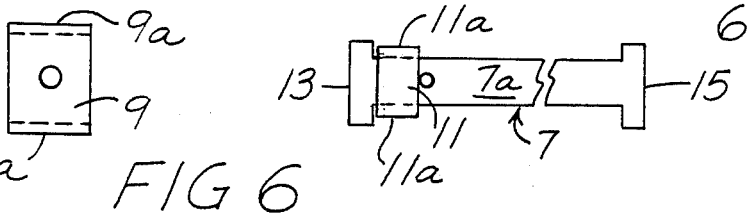
FIG. 6 is a bottom view of the pedestal taken along line 6—6 of FIG. 5, showing the tie bar in open position.

From the foregoing, it will be evident that the tie bar can be slid between a fully closed position, as shown in FIG. 1, and a fully opened position, as shown in FIG. 5, but that due to the interference of flanges 11*a* of saddle 11 and shoulders 13 and 15, tie bar 7 cannot be removed from saddle 11.

Operation of the invention is as follows: Initially the structure is assembled by positioning tie bar 7 against the feet 3*c* and 5*c* of the pedestals, welding saddles 11 and 9 to the pedestal feet with saddle 11 offset from pedestal leg web 5*a* a sufficient distance to receive shoulders 13, and with shoulders 15 in engagement with the adjacent end of saddle 11, drilling the pedestal foot 3*c*, tie bar 7 and saddle 9 to receive bolt 17, inserting bolt 17, and applying nut 19 to it to hold the pedestal tie bar 7 in closed position. For opening pedestal tie bar 7 in order to insert or remove journal box 6 nut 19 is removed from bolt 17, the latter lifted clear of tie bar 7 and tie bar 7 slid to the right, as seen in FIG. 1, until the shoulder on its widened end 13 engages the opposing end of saddle 11, at which time the end 13 of tie bar 7 is substantially flush with the inner transverse surface of pedestal leg web 5*a*. Because of the fact that shoulders formed by ends 13 and 15 are wider than the opening between flanges 11*a* of saddle 11, the tie bar cannot be removed from saddle 11. When it is desired to close the pedestal, tie bar 7 is slid through saddle 11 and across the pedestal jaw, thence through saddle 9 until shoulders 15 engage the opposing transverse face of saddle 11, after which bolt 17 is inserted through pedestal foot 3*c*, tie bar 7 and saddle 9 and nut 19 applied to bolt 17.

The details of the pedestal arrangement disclosed herein may be varied substantially without departing from the spirit of the invention and the exclusive use of such modifications as come within the scope of the appended claims is contemplated.

We claim:

1. In combination with a railway truck pedestal having longitudinally spaced vertical legs defining between them a vertical opening and terminating in downwardly facing horizontal feet, means on said pedestal legs forming separate longitudinally extending relatively wide and narrow apertures beneath the respective feet, said separate aperture-forming means being spaced from each other at least as far as the width of said opening in said pedestal, a pedestal tie bar slidably mounted in said apertures and extending across the opening in said pedestal and having a shank portion narrower than both of said apertures and permanently affixed enlarged end portions wider than said narrow aperture to prevent removal of said tie bar in either direction from said narrow aperture, said enlarged end portions forming transverse shoulders adjoining said shank, said wide aperture being wider than both said tie bar end portions to permit said tie bar to be moved longitudinally from its normal tying position across said opening in said pedestal to an open position clear of said opening in said pedestal, and removable means for retaining said tie bar in tying position across said opening in said pedestal.

2. The combination according to claim 1, wherein said aperture forming means comprises upwardly open channel-shaped saddles connected by their flanges to said pedestal feet.

3. The combination according to claim 2, wherein said saddle forming said narrow aperture is offset longitudinally from the inner vertical transverse face of the respective pedestal leg a distance equal at least to the thickness of the opposite enlarged end portion of the pedestal tie bar to permit the end surface of said pedestal tie bar to clear the opening in said pedestal when said tie bar is moved to its fully retracted position.

4. The combination according to claim 3, wherein said bolt holes are formed in the pedestal foot and saddle forming said wide aperture and are aligned with the corresponding hole in said tie bar when the shoulders on the opposite end of said tie bar abuttingly engage said saddle forming said narrow aperture.

5. The combination according to claim 4, wherein said pedestal legs are of channel cross section and said pedestal leg feet are horizontal webs intersecting the vertical webs and flanges of said channel cross section legs, the horizontal web forming the foot of one of said pedestal legs being apertured to receive said bolt.

6. The combination according to claim 2, wherein at least one of said pedestal feet comprises a horizontal web and said removable retaining means comprises a bolt passing through vertically aligned holes formed in said horizontal web and the corresponding end of the tie bar and saddle.

7. The combination according to claim 2, wherein said saddle forming said narrow aperture is sufficiently wide to slidably receive the shank of said tie bar but is narrower than the end portions of said tie bar and said saddle forming said wide aperture is sufficiently wide to slidably receive the correspondingly widened end portion of said tie bar.

* * * * *